US005757114A

United States Patent [19]

Jaskie

[11] Patent Number: 5,757,114

[45] **Date of Patent: *May 26, 1998**

[54] ENHANCED ELECTRON EMITTER

[75] Inventor: James E. Jaskie, Scottsdale, Ariz.

[73] Assignee: Motorola, Inc., Schaumburg, Ill.

[ * ] Notice: The term of this patent shall not extend beyond the expiration date of Pat. No. 5,619,092.

[21] Appl. No.: 740,457

[22] Filed: Oct. 29, 1996

Related U.S. Application Data

[62] Division of Ser. No. 618,484, Mar. 19, 1996, which is a continuation of Ser. No. 11,595, Feb. 1, 1993, Pat. No. 5,619,092.

[51] Int. Cl.[6] ..... H01J 1/02

[52] U.S. Cl. ..... 313/309; 313/351

[58] Field of Search ..... 313/309, 311, 313/336, 351, 495

[56] References Cited

U.S. PATENT DOCUMENTS 5,619,092 4/1997 Jaskie ..... 313/309

*Primary Examiner*—Richard Chilcot
*Assistant Examiner*—Harshad Patel
*Attorney, Agent, or Firm*—Eugene A. Parsons

[57] ABSTRACT

An electron emitter formed with a layer of diamond-like carbon having a diamond bond structure with an electrically active defect at an emission site. The electrically active defect acts like a very thin electron emitter with a very low work function and improved current characteristics, including in improved saturation current.

7 Claims, 6 Drawing Sheets

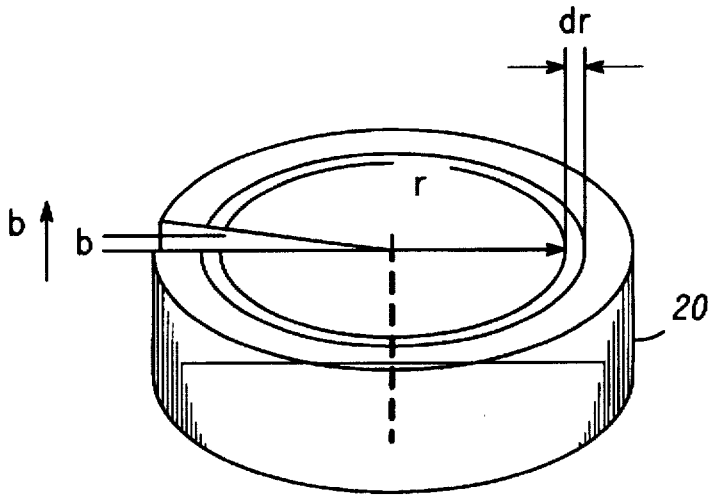
FIG. 5
FIG. 6
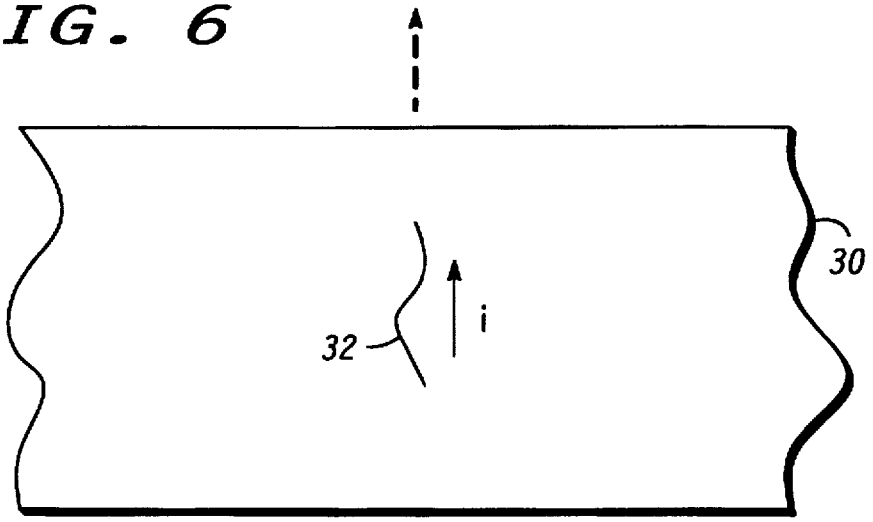

-PRIOR ART-

ENHANCED ELECTRON EMITTER

CROSS-REFERENCE TO RELATED APPLICATIONS

This application is a divisional application of application Ser. No. 08/618,484 filed 19 Mar., 1996, which is a continuation application of Ser. No. 08/011,595 filed 1 Feb., 1993, now Pat. No. 5,619,092.

The present invention pertains to improved electron emitters and more specifically to electron emitters with improved current characteristics in devices such as field emission devices.

BACKGROUND OF THE INVENTION

It is known that diamond has a negative electron affinity. It is also known that diamonds emit electrons because of this negative electron affinity and, indeed, emit at much lower fields than other common electron emitters such as molybdenum or tungsten. This is currently not a controllable function. The emitter current is often much lower than would be predicted and some samples that seem to have all the criteria for emission often do not emit at all.

Because of the large energy bandgap (5.5eV) between the valence and conduction bands, the number of carriers in a diamond semiconductor is necessarily low at room temperatures. Currently known dopants have very large ionization energies in diamond (on the order of 1eV) and hence contribute poorly to conduction below +250° C. So even though the effective work function of diamond is positive and considered to be somewhere between 0.2eV and 0.7eV (even though its electron affinity is negative) its saturation current is low. Raising the saturation current is the primary problem to be solved.

SUMMARY OF THE INVENTION

It is a purpose of the present invention to provide an electron emitter with improved current characteristics.

It is a further purpose of the present invention to provide a diamond or diamond-like carbon electron emitter with improved current characteristics.

It is another purpose of the present invention to provide a diamond or diamond-like carbon electron emitter with improved saturation current.

It is a further purpose of the present invention to provide field emission devices with diamond or diamond-like emitters having improved current characteristics.

The above problems are solved and purposes realized in an electron emitter formed with a layer of material having a predetermined structure with an electrically active defect in the structure at an emission site.

The above problems are solved and purposes realized in an electron emitter formed with a layer of material including diamond or diamond-like carbon having a diamond bond structure with an electrically active defect at an emission site.

The above problems are solved and purposes realized in a field emission device including a supporting substrate having a layer of material including diamond or diamond-like carbon formed on a surface thereof, the diamond or diamond-like carbon having a diamond bond structure with an electrically active defect defining an electron emitter.

BRIEF DESCRIPTION OF THE DRAWINGS

Referring to the drawings:

FIG. 5 is a schematic representation of a screw defect in a diamond bond;

FIG. 6 is a greatly enlarged cross-sectional representation of a layer of diamond-like carbon with an electrically active defect;

DESCRIPTION OF THE PREFERRED EMBODIMENT

Figure 1:
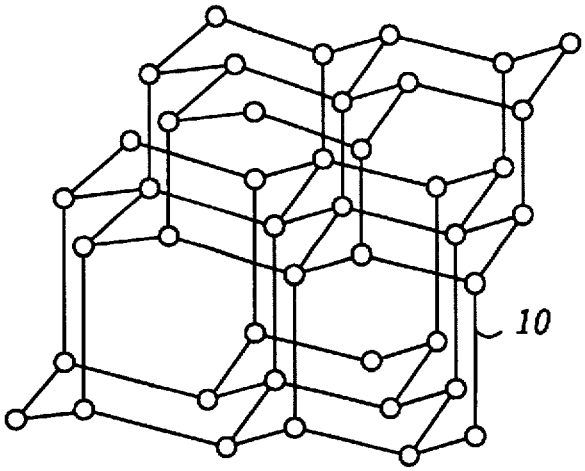
FIG. 1 illustrates the lattice structure of diamond-like carbon.

Referring specifically to FIG. 1, tetrahedral bonded atoms in a lattice structure 10 of diamond-like carbon are illustrated. For the purposes of this disclosure, it should be understood that "diamond-like carbon" is defined as carbon in which the bonding is formed by carbon atoms bonded generally into the well known diamond bond, commonly referred to as an abundance of $sp^3$ tetrahedral bonds, and includes diamond as well as any other material containing the diamond bond. Also, for the purposes of this disclosure, it should be understood that "graphite-like carbon" is defined as crystalline carbon in which the lattice structure is formed by carbon atoms bonded generally into the well known graphite bond, commonly referred to as an abundance of $sp^2$ bonds , and includes graphite as well as any other material containing the graphite bond.

The space lattice structure of carbon as diamond is face-centered cubic (fcc). The primitive basis for this lattice is two identical carbon atoms at 0, 0, 0, and ¼, ¼, ¼ associated with each lattice point. This gives a tetrahedral bonding and each carbon atom has four nearest neighbors and twelve next nearest neighbors with eight carbon atoms in a unit cube. This structure is a result of covalent bonding. In this covalent structure there is a definite link between specific atoms, with the shared electrons spending most of their time in the region between the two sharing atoms (i.e. the probability wave is the most dense between the atoms). This creates a bond consisting of a concentration of negative charge and, hence, neighboring bonds repel one another. When an atom, such as carbon, has several bonds (4 in diamond) the bonds occur at equal angles to one another, which angle is 109° in diamond. The covalent bond is a directed bond, and very strong. The binding energy of a carbon atom in diamond is 7.3eV with respect to separated neutral atoms.

Figure 2:
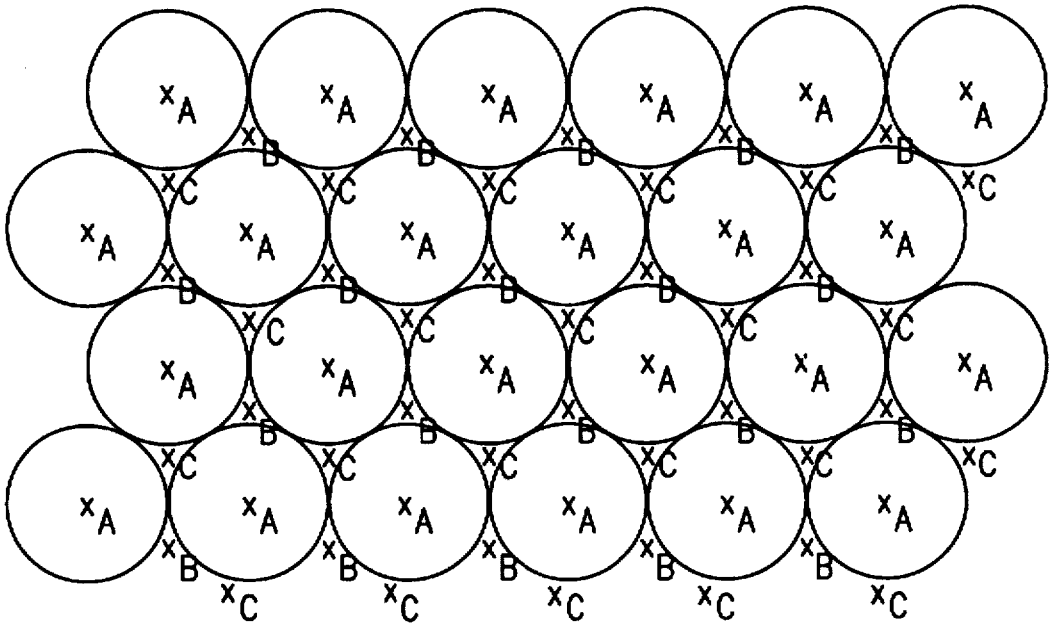
FIG. 2 illustrates the stacking structure of carbon in a diamond-like material.

Diamond-like lattice structure 10, illustrated in FIG. 1, is very interesting because the (111) plane in this structure is the same as the basal plane of a hexagonal closely packed (hcp) structure. Referring to FIG. 2, if a (111) layer (atoms designated A) is provided and a second similar layer (atoms designated B) is arranged on top, the structure is indistinct from the hcp. That is, the structure could be face centered cubic or hexagonal closely packed. When a third layer (atoms designated C) is placed on the structure a decision between an hcp and an fcc structure must be made. If the third layer is placed on the structure in the same location as the first layer, that is with the C atoms directly over the A atoms but displaced in the Z direction, the structure is an hcp structure, or graphite. The layers of such a structure can be described as an ABABABAB structure. If the third layer is placed in a second possible location, displaced from both the A and B atoms in the X, Y and Z directions (see FIG. 2), the structure becomes an fcc structure, or diamond. The layers of FIG. 2 can be described as an ABCABCABC structure. In both structures (graphite and the diamond of FIGS. 2) the number of nearest neighbors is four. If the binding energy was dependent only on the nearest neighbor bonds, there would be no difference between the fcc structure of diamond and the hcp structure of graphite. However, the atoms within a layer of graphite are 1.4Å apart and bound by strong covalent bonds, but between layers the separation of atoms is 3.3Å and there are only weak van der Waals forces. The covalent bonds for graphite are planar, that is, the bonds lie in a plane separated by 90°.

The electrical properties of diamond and graphite are very different. Diamond, type IIb naturally doped with boron, has a resistivity of $10^4$ohm-cm, up to greater than $10^{14}$ohm-cm for intrinsic diamond. Graphite is effectively a metallic conductor with a conductivity of $1375\times10^{-6}$ohm-cm. This is a difference of at least 7 orders of magnitude and as great as 20 orders of magnitude for the intrinsic properties. Graphite is a semi-metal with about $5\times10^{18}$ carriers per $cm^3$. Electrical conductivity of graphite is much greater in directions parallel to the hexagonal planes and low in the perpendicular direction (c-axis). The different orientations of the covalent bonds with their attendantly different energy levels act as efficient electrical conduction paths. Thus, there are great differences in electrical properties for very small changes in the crystal structure between graphite and diamond.

Figure 3:
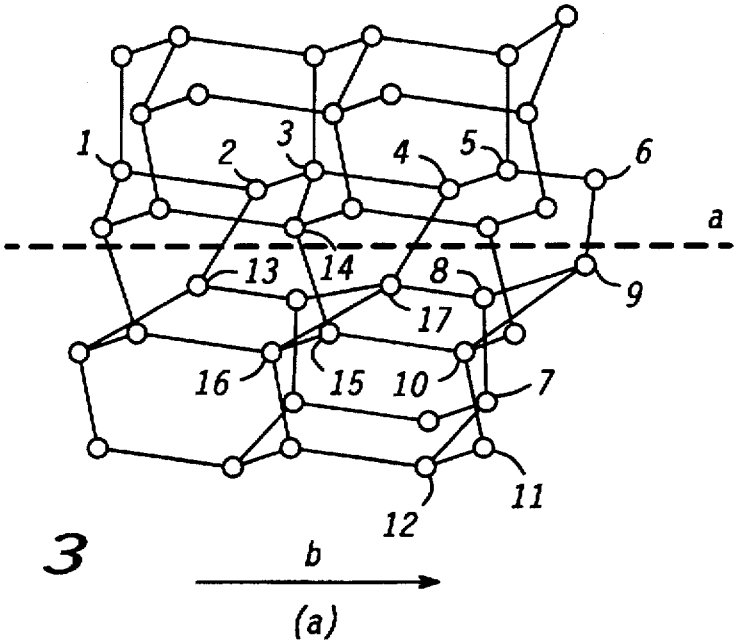
FIG. 3 illustrates the lattice structure of diamond-like carbon with a first type of dislocation forming an electrically active defect.
Figure 4:
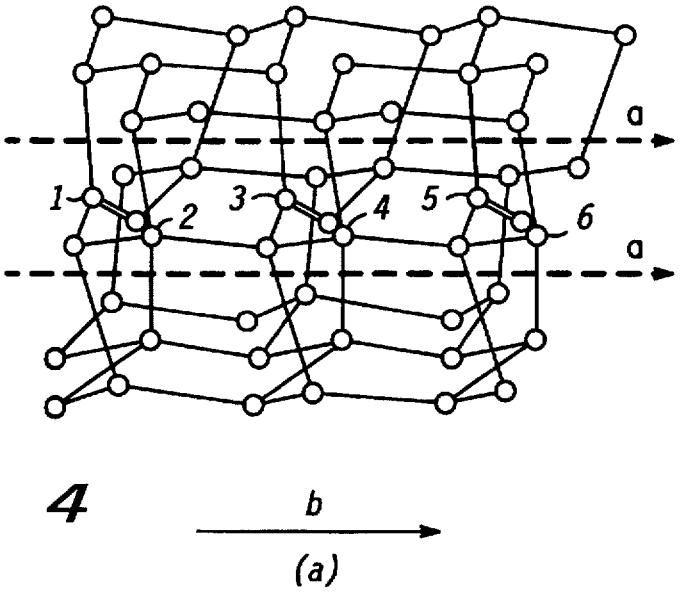
FIG. 4 illustrates the lattice structure of diamond-like carbon with a second type of dislocation forming an electrically active defect.

There are several types of crystal defects that can occur in diamond and which will produce the useful properties of the present invention. A first defect is the screw dislocation, two embodiments of which are illustrated in FIGS. 3 and 4. There are also 60° dislocations that may easily form extended networks, and many other dislocations and variations. In the diamond lattice there are three slip planes, the (001), (110) and (111) planes. The (111) plane is the most important slip plane, and indeed, it appears that this is the only slip plane that occurs under any but the most bizarre circumstances.

From a consideration of the lattice, it is clear that the shortest transitional distance between any two carbon atoms in the diamond lattice is along the <110> direction (specifically, <½, ½, 0>, that is along half the diagonal of a cubic face). Dislocations with Burgers vectors in the <110> direction are the most stable (lowest free energy). Any arbitrary direction in this lattice can be considered as the sum of successive <110> directions, and simple dislocations will have these same directions for their axes. The three types of simple dislocations, having both their Burgers vectors and axes along the <110> direction are the screw dislocation, the 60° dislocation (with its Burgers vector 60° to the dislocation axis) and an edge type dislocation with a (100) glide plane. All of these dislocations are useful as electrically active defects.

Referring specifically to FIG. 5, a schematic representation of a screw defect in a diamond lattice is illustrated. A screw defect is generally the result of shear, which occurs during the growth or deposition process of the diamond material. This dislocation, like others, creates an elastic strain field in the surrounding crystal. For purposes of this explanation, if a thin annulus 20 centered about a screw dislocation, with radius r, thickness dr and unit length where the screw dislocation is of strength b along the axis causing shear of annulus 20 by an amount b, the average shear is b/2π and the shear stress is $$\tau_{\theta z} = \frac{Gb}{2\pi r}$$

where G=shear modulus. It should be noted that the stress decreases as 1/r and, hence, the strain is long range. The strain energy of annulus 20 per unit length is $$\frac{\tau_{\theta z}^2}{2G} * 2\pi r\, dr = \frac{Gb^2 dr}{4\pi r}$$

The strain energy of the diamond crystal per unit dislocation length is $$\frac{Gb^2}{4\pi}\int_{Ro}^{R}\frac{dr}{r} = \frac{Gb^2}{4\pi}\ln\left(\frac{R}{Ro}\right)$$

where Ro and R are the lower and upper limits. Ro is the lower limit for this integration, that is, the level below which Hooke's law is not valid and the material behaves atomically. The value for Ro is not critical because the energy is a logarithmic function thereof. Upper level R is the boundary of the crystal or the point at which other dislocations cancel out the stress field. It should be noted that since the energy of the strain field created by the dislocation is a function of the square of the Burgers vector b, the crystal minimizes its free energy by dividing multiple dislocations into unit dislocations. When two dislocations with Burgers vectors $b_1$ and $b_2$ combine into one dislocation with Burgers vector $b_3$, the increase in free energy is $^{\Delta E=\Delta E_{el}}$, assuming the change in the irreversibility, TΔs, is not large. This is a reasonable assumption in an elastic strain field, where there is no lattice reorganization. $^{\Delta E}$el is proportional to $(b_3^2-b_2^2-b_1^2)$. When $^{\Delta E}$el is positive, the dislocation will be unstable and dislocations 1 and 2 will repel each other. When $^{\Delta E}$el is negative the dislocation will be stable and dislocations 1 and 2 will attract one another. Because of the squared Burgers vector magnitude term in the elastic energy, multiple dislocations at a site are rare (e.g. $E_{b3} > (E_{b2}+E_{b1})$).

Some typical values which may be entered into the equation for strain energy are:

G=$10^8$psi (very conservative);

b=2.5Å;

Ro=1b; and

R=1μM.

The maximum radius of the strain, R, is selected arbitrarily as 1μM. The actual maximum radius might be as far as the boundaries of the crystal. In reality, the range of the strain field from a crystal defect is typically as far as the distance to another defect that cancels out the strain field with its own strain field.

The energy of the strain field is comparatively insensitive to both R and Ro. The energy varies as the logarithm of the ratio of the maximum field radius and minimum field radius (before the material behaves atomically). This example using the above numbers is a reasonable calculation of the magnitude of the energy to be used for estimating the possible behavior of the lattice. Utilizing the above numbers, the strain energy becomes 17.8eV/Å, or 44.4eV per bond length. This is clearly enough energy to break the covalent bond of the diamond lattice and to allow local reconfiguration. It is possible to have both single bonds and even double bonds broken and reformed. By reconfiguring the bonds into covalent bonds remaining in a plane, a monolayer of graphite-like material is formed, along with its electrical properties. This thin film of graphitic structure then lends its properties to that of the diamond and an electrically active defect is formed.

Figure 7:
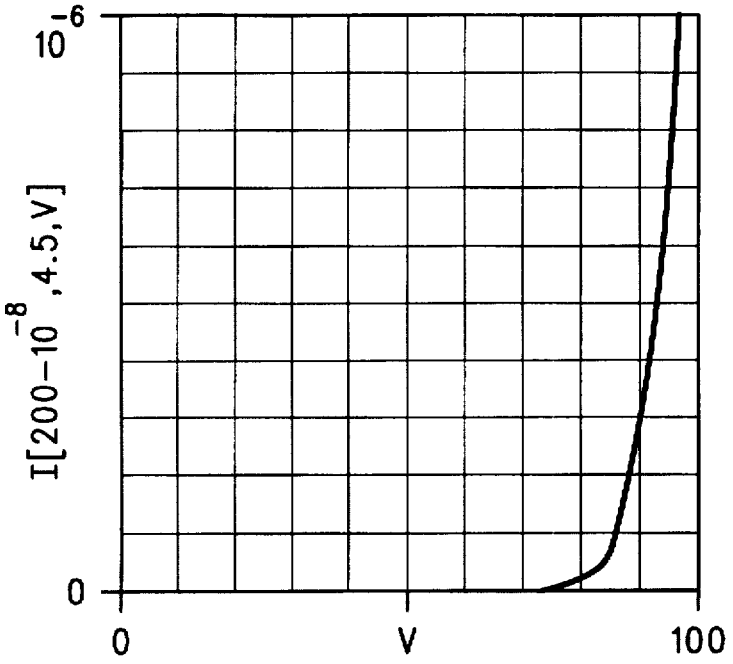
FIGS. 7 and 8 are graphs illustrating electron emission properties of a prior art field emission device and the device of FIG. 6, respectively.
Figure 8:
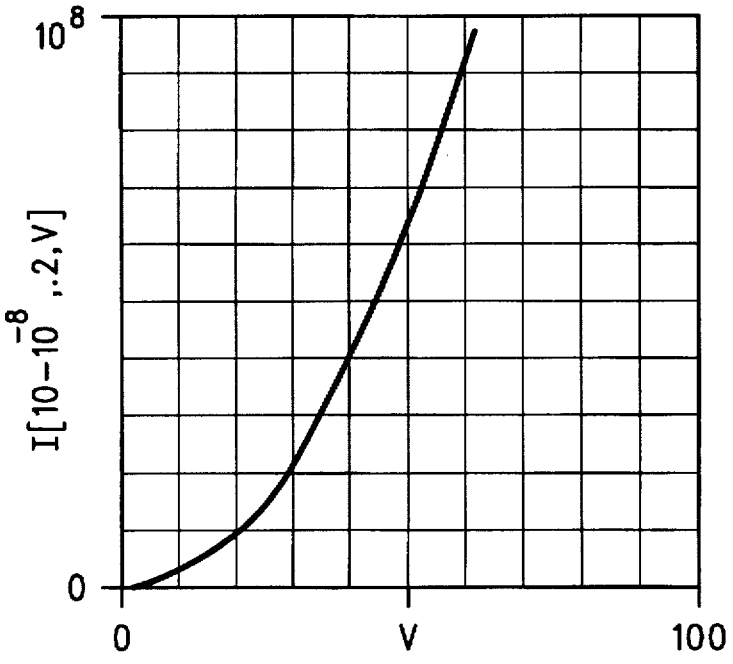

Referring specifically to FIG. 6, a layer 30 of diamond-like material having an electrically active defect 32 is illustrated. Generally, defect 32 in layer 30 operates similar to an electron emitter formed of a sharp tip (10 angstrom radius) of a metallic conductor with a thin (10's of angstroms) diamond coating. The improvement of this structure over prior art type field emission devices is apparent from FIGS. 7–9. FIGS. 7 and 8 are graphs illustrating electron emission properties of a prior art field emission device, such as the tip commonly referred to as a Spindt emitter, and the device of FIG. 6, respectively. FIG. 7 is a graph of emitted current, I, vs. voltage, or the field potential, applied to the tip. In FIG. 7 a typical prior art tip with a radius of 200Å and a work function of the material of 4.5eV is utilized. In the graph of FIG. 8, it can be seen that the emitter of FIG. 6 operates like an emitter tip having a radius of 10Å and a work function of the material of 0.2eV. Further, the electron emission is substantially greater for the emitter of FIG. 6 with a substantially smaller voltage, or field potential, applied.

Figure 9:
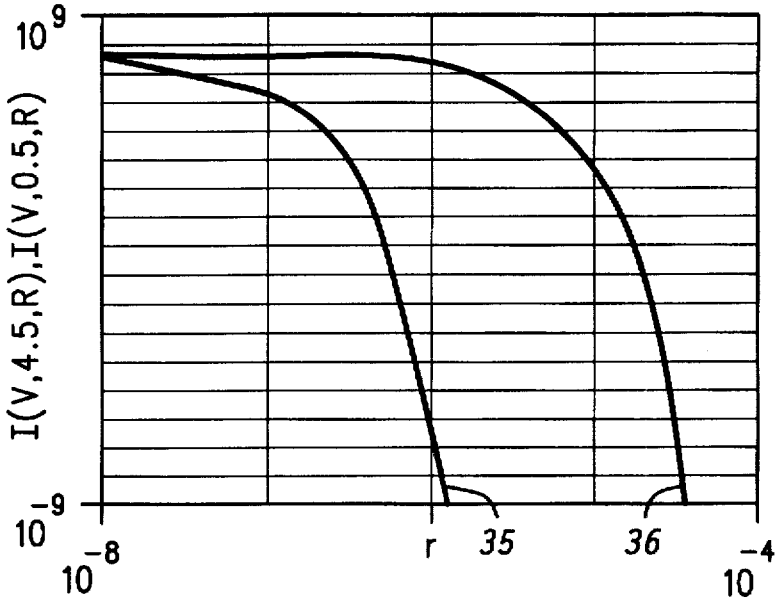
FIG. 9 is a graph comparing electron emission of a device, similar to the device of FIG. 6 with the defect at the surface of the layer, to a prior art field emission device as the radius of the emitter varies.

Because the structure of FIG. 6 appears as a sharp tipped emitter, an alternative structure also exists. When electrically active defect 32 is positioned such that free electrons in defect 32 see free space without the diamond layer (i.e., at the surface of layer 30), defect 32 appears as a simple field emitter. FIG. 9 is a graph comparing electron emission of the surface defect described above (curve 36), to a prior art field emission device (curve 35). Curves 35 and 36 depict electron emission for a free standing rod in an electric field as a function of tip radius, wherein a molybdenum rod with a work function of 4.5eV is used for curve 35 and the above described surface defect with a work function of 0.5eV is used for curve 36. At the smaller diameters, the advantage of the lower work function of the surface defect is slowly lost to the sharp tip. If the standing rod is sharp enough, its work function approaches unimportance. Low work function is still desirable, but it becomes less necessary for enhanced emission as the emitter diameter shrinks. Since the defect described above (i.e., at the surface of the diamond) appears sharper than virtually any prior art field emitter tip, it has a substantial advantage in both work function and radius.

Figure 10:
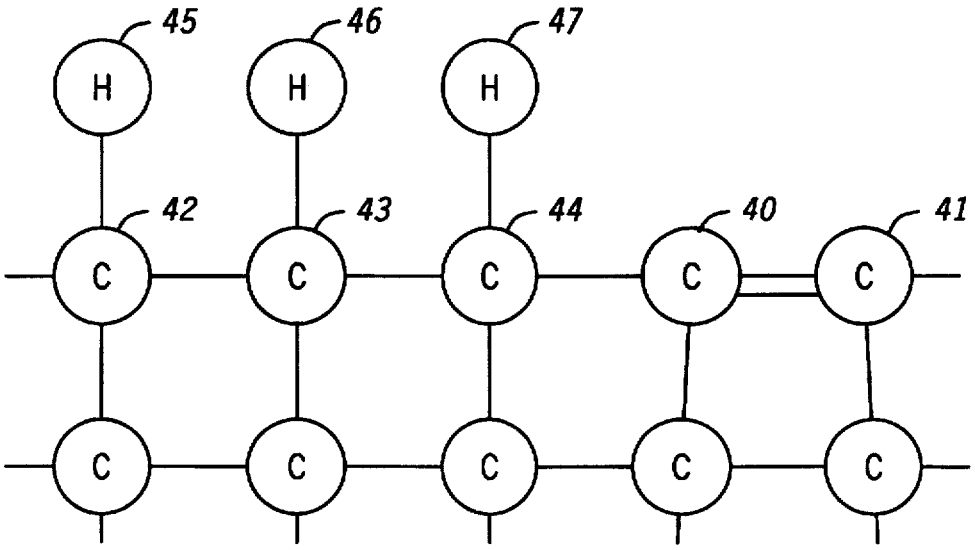
FIG. 10 illustrates the lattice structure of a hydrogenated surface of diamond-like carbon.

It is apparent that lowering the tunneling barrier of a conductive element greatly raises the emitted current. This change in work function is clearly an important effect, and it links the defect's behavior to the surface of the diamond. In other words, if the surface of the diamond is contaminated or reconfigured into a non-diamond structure (except for the example above), the gain may be lost. To insure that a diamond layer has the diamond bond structure, even at a surface, a process known as hydrogenation is performed on exposed surfaces. Referring to FIG. 10, this process is illustrated by a simplified diamond bond. Here it can be seen that carbon atoms 40 and 41, which are not hydrogenated, have reconfigured into a stable low energy structure that is not an extension of the bulk and, hence, does not have the properties of the bulk. A double bond has formed between carbon atoms 40 and 41 which is stronger than the surrounding single bonds and, thus, draws carbon atoms 40 and 41 slightly closer together. The low energy structure formed by carbon atoms 40 and 41 is a poor electron emitter and is undesirable in devices that require this property from the diamond.

Carbon atoms 42, 43 and 44 have been hydrogenated, that is an atom of hydrogen 45, 46 and 47, respectively, is attached by a single bond. Thus, the lattice structure formed by carbon atoms 42, 43 and 44 appears the same at the surface and, therefore, appears as an extension of the bulk. Since the lattice structure of carbon atoms 42, 43 and 44 is an extension of the bulk it has the properties of the bulk and, therefore, is a good electron emitter.

Figure 11:
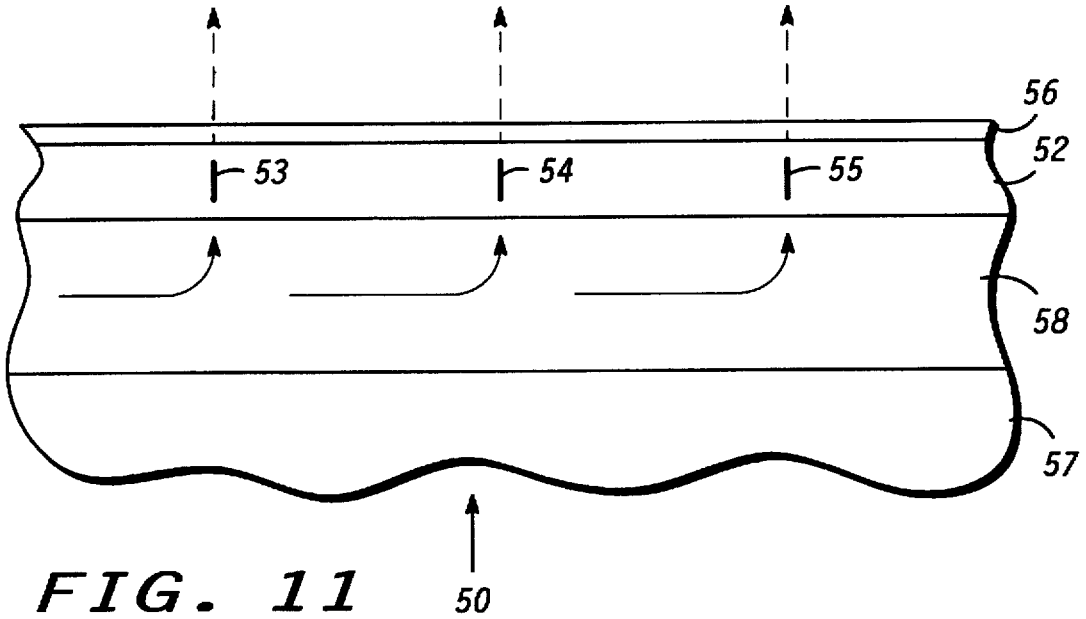
FIG. 11 is a cross-sectional representation of a field emission device employing a hydrogenated layer of diamond-like carbon with electrically active defects.

FIG. 11 illustrates a cross-sectional representation of a field emission device 50 employing a hydrogenated layer 52 of diamond-like carbon with electrically active defects 53, 54 and 55. The hydrogenation of layer 52 is illustrated by a layer 56 on the surface thereof. Electrically active defects 53, 54 and 55 appear generally periodically spaced and substantially perpendicular to the surface although it should be understood that some angular changes and some differences in spacing may occur. It is believed, for example, that the elongated defects should be positioned at an angle to the surface of the diamond-like carbon layer for best results. Further, it is believed that it is best if the elongated defect makes an angle in the range of 45° to 90° with the surface.

Device 50 further includes a supporting substrate 57 having a conductive layer 58 formed on a surface thereof. Conductive layer 58, or layers, provide the means to electrically communicate with defects 53, 54 and 55. Thus, as illustrated, electrical current flows in conductive layer 58 from a source (not shown) and is emitted by defects 53, 54 and 55 into the free space above layer 56.

There are many possible kinds of lattice imperfections; vacancies, interstitials, impurities, dislocations, cellular and lineage substructure, grain boundaries, and surfaces. Vacancies in a lattice can actually lower the free energy of a crystal and are therefore present at equilibrium. Dislocations, which are of greater interest, do not lower the free energy of a crystal but instead raise it. Dislocations , therefore, are a nonequilibrium type of defect and, generally, can be formed only as a result of nonequilibrium conditions during growth of the crystal. There are several types of disturbances that can be effective in producing dislocations. These are: (a) externally applied stress of mechanical origin; (b) thermally induced stress; (c) local stress due to concentration gradients of impurities; (d) condensation of sufficient vacancies; (e) inclusion induced local stress; and (f) mistakes in the growth process. In the diamond bond, externally applied mechanical stress can generally be eliminated because of the strength of the material. Thermally induced stresses during growth and "mistakes" during the growth process are the two leading causes of dislocations in the diamond material that are used to produce the desired defects. The "mistakes" in growth generally are introduced by multiple nucleation sites seeding crystal grains that grow and conflict. When two nucleation sites are sufficiently separated or dissimilar in orientation, the growing crystals eventually meet and become different grains in the polycrystalline material. If the orientation of the two seeds is sufficiently similar, but not identical, the growing lattices meet and join with a resultant screw dislocation.

The ion implantation of Carbon C+ has been used in the past to make diamond material conductive and n-type. This ion implantation can be used to create defects that are conductive because of the changed bond structure in the crystal lattice. While this technique does not, at the present time, create the long conductive filament defects that is best for electron emission, it should be understood that some benefits may be gained and it is fully intended that these come within the scope of this invention.

Therefore, a diamond-like carbon electron emitter with improved current characteristics, including improved saturation current, has been disclosed. The improved current characteristics are realized through the incorporation of an electrically active defect which locally enhances electron emission. Specifically, the defect is formed of the same basic material with a different structure. Further, a field emission device with a diamond-like emitter, having improved current characteristics, is disclosed. It should be noted that while carbon has been described throughout this disclosure, electron emitters incorporating other materials, such as aluminum nitride, might be enhanced in a similar fashion, i.e.,by including an electrically active defect.

While I have shown and described specific embodiments of the present invention, further modifications and improvements will occur to those skilled in the art. I desire it to be understood, therefore, that this invention is not limited to the particular forms shown and I intend in the append claims to cover all modifications that do not depart from the spirit and scope of this invention.

What is claimed is:

1. An electron emitter formed with material that includes first phase portions characterized by a first chemical bond and second phase portions characterized by a second chemical bond, the first and second phase portions being positioned adjacent each other so as to define a non-segregated multi-phase region in which properties of the two phase portions are blended to create an enhanced electron emission structure with locally enhanced electron emission.

2. An electron emitter as claimed in claim 1 wherein the first chemical bond is $sp^3$ and the second chemical bond is $sp^2$.

3. An electron emitter as claimed in claim 1 wherein the first chemical bond is diamond-like carbon and the second chemical bond is graphite-like carbon.

4. An electron emitter as claimed in claim 1 wherein the first and second chemical bonds are formed in aluminum nitride.

5. An electron emitter as claimed in claim 1 wherein the layer of material has a substantially flat surface with the enhanced electron emission structure positioned adjacent the surface at a selected emission site.

6. An electron emitter as claimed in claim 5 wherein the layer of material has a plurality of enhanced electron emission structures positioned adjacent the surface, one each positioned at a plurality of selected emission site.

7. A field emission device comprising:

an electron emitter formed with material that includes first phase portions characterized by a first chemical bond and second phase portions characterized by a second chemical bond, the portions being positioned adjacent each other so as to define a non-segregated multi-phase region in which properties of the first and second phase portions are blended to create an enhanced electron emission structure with locally enhanced electron emission;

a conductive layer positioned adjacent the electron emitter and in electrical communication with the enhanced electron emission structure; and a source connected to the conductive layer so as to cause a current flow through the conductive layer and emission current from the enhanced electron emission structure.

* * * * *